US012133552B2

(12) United States Patent
Vollmer et al.

(10) Patent No.: US 12,133,552 B2
(45) Date of Patent: Nov. 5, 2024

(54) CARTRIDGE WITH TWO PORTION SUBSTRATE FOR USE WITH AEROSOL GENERATING DEVICE

(71) Applicant: PHILIP MORRIS PRODUCTS S.A., Neuchâtel (CH)

(72) Inventors: Jean-Yves Vollmer, Fontaines-sur-Grandson (CH); Sébastien Capelli, Cernier (CH); Onur Dayioglu, Neuchâtel (CH)

(73) Assignee: Philip Morris Products S.A., Neuchâtel (CH)

( * ) Notice: Subject to any disclaimer, the term of this patent is extended or adjusted under 35 U.S.C. 154(b) by 582 days.

(21) Appl. No.: 17/311,956

(22) PCT Filed: Dec. 17, 2019

(86) PCT No.: PCT/IB2019/060917

§ 371 (c)(1),
(2) Date: Jun. 8, 2021

(87) PCT Pub. No.: WO2020/128828

PCT Pub. Date: Jun. 25, 2020

(65) Prior Publication Data

US 2022/0061382 A1 Mar. 3, 2022

(30) Foreign Application Priority Data

Dec. 17, 2018 (EP) ..... 18213185

(51) Int. Cl.

| | |
|---|---|
| ***A24F 40/30*** | (2020.01) |
| ***A24B 15/14*** | (2006.01) |
| ***A24B 15/167*** | (2020.01) |
| ***A24D 1/20*** | (2020.01) |
| ***A24F 40/20*** | (2020.01) |

(Continued)

(52) U.S. Cl.
CPC ..... *A24F 40/30* (2020.01); *A24B 15/14* (2013.01); *A24B 15/167* (2016.11); *A24D 1/20* (2020.01);

(Continued)

(58) Field of Classification Search
CPC ..... A24F 40/30; A24F 40/20; A24F 40/42; A24F 40/48; A24F 40/485; A24F 40/40;

(Continued)

(56) References Cited

U.S. PATENT DOCUMENTS

2011/0094523 A1 4/2011 Thorens et al.
2017/0064999 A1 3/2017 Perez et al.

(Continued)

FOREIGN PATENT DOCUMENTS

EP 2179667 A1 4/2010
JP 2016-513453 A 5/2016

(Continued)

OTHER PUBLICATIONS

Extended European Search Report for EP Application No. 18213185.4, issued by the European Patent Office on Jul. 9, 2019: 10 pgs.

(Continued)

*Primary Examiner* — Justin M Kratt
(74) *Attorney, Agent, or Firm* — Mueting Raasch Group

(57) ABSTRACT

A cartridge (100) for use with an aerosol generating device (200) includes a housing (110) and an aerosol-forming substrate (500) disposed in the housing (110). The aerosol-forming substrate (500) has a first portion (510) that includes a tobacco powder, and a second portion (520) that includes a gel. The first portion is adjacent the second portion. The gel includes an aerosol former.

14 Claims, 5 Drawing Sheets

(51) Int. Cl.

| | |
|---|---|
| ***A24F 40/42*** | (2020.01) |
| ***A24F 40/48*** | (2020.01) |
| ***A24F 40/485*** | (2020.01) |
| *A24B 15/10* | (2006.01) |
| *A24B 15/12* | (2006.01) |
| *A24B 15/16* | (2020.01) |
| *A24B 15/32* | (2006.01) |
| *A24D 1/14* | (2006.01) |
| *A24D 1/18* | (2006.01) |
| *A24F 40/40* | (2020.01) |
| *A24F 40/46* | (2020.01) |

(52) U.S. Cl.
CPC ..... *A24F 40/20* (2020.01); *A24F 40/42* (2020.01); *A24F 40/48* (2020.01); *A24F 40/485* (2020.01); *A24B 15/10* (2013.01); *A24B 15/12* (2013.01); *A24B 15/16* (2013.01); *A24B 15/32* (2013.01); *A24D 1/14* (2013.01); *A24D 1/18* (2013.01); *A24F 40/40* (2020.01); *A24F 40/46* (2020.01)

(58) Field of Classification Search
CPC ..... A24F 40/46; A24B 15/14; A24B 15/167; A24B 15/10; A24B 15/12; A24B 15/16; A24B 15/32; A24D 1/20; A24D 1/14; A24D 1/18
See application file for complete search history.

(56) References Cited

U.S. PATENT DOCUMENTS

| | | | | |
|---|---|---|---|---|
| 2017/0119055 | A1 | 5/2017 | Liu | |
| 2017/0265523 | A1 | 9/2017 | Lipowicz | |
| 2018/0027883 | A1 | 2/2018 | Zuber et al. | |
| 2018/0029782 | A1* | 2/2018 | Zuber | A24F 40/42 |
| 2018/0352862 | A1 | 12/2018 | Mironov et al. | |
| 2018/0352866 | A1* | 12/2018 | Tucker | H05B 3/12 |
| 2019/0200679 | A1 | 7/2019 | Dayioglu et al. | |

FOREIGN PATENT DOCUMENTS

| | | | | |
|---|---|---|---|---|
| KR | 20140067691 | A | 6/2014 | |
| WO | WO 2012/043941 | A1 | 4/2012 | |
| WO | WO 2014/138244 | A1 | 9/2014 | |
| WO | WO 2015/149311 | A1 | 10/2015 | |
| WO | WO 2016/050469 | A1 | 4/2016 | |
| WO | WO 2016/069876 | A1 | 5/2016 | |
| WO | WO-2017089939 | A1 * | 6/2017 | A24B 15/167 |
| WO | WO 2018/019578 | A1 | 2/2018 | |
| WO | WO-2020025730 | A1 * | 2/2020 | A24B 15/14 |

OTHER PUBLICATIONS

International Search Report and Written Opinion for PCT/IB2019/060917, issued by the European Patent Office on Apr. 3, 2020; 12 pgs.

Written Opinion of the International preliminary Examining Authority for PCT/IB2019/060917, issued by the European Patent Office on Oct. 27, 2020; 12 pgs.

International Preliminary Report on Patentability for PCT/IB2019/060917, issued by the European Patent office on Mar. 19, 2021; 20 pgs.

Japanese Office Action for JP Application No. 2021-531560 issued by the Japanese Patent Office on Jan. 9, 2024; 15 pgs. including English translation.

* cited by examiner

CARTRIDGE WITH TWO PORTION SUBSTRATE FOR USE WITH AEROSOL GENERATING DEVICE

This application is the § 371 U.S. National Stage of International Application No. PCT/IB2019/060917, filed 17 Dec. 2019, which claims the benefit of European Application No. 18213185.4, filed 17 Dec. 2018, the disclosures of which are incorporated by reference herein in their entireties.

The disclosure relates to a consumable for use with an aerosol generating article. The consumable comprises an aerosol forming substrate that comprises a portion containing tobacco and a gel portion comprising an aerosol former, such as glycerol. In use, the consumable may be heated by an aerosol generating article to melt the gel, which may form a mixture with the tobacco to generate an aerosol. The consumable may also comprise a flow control apparatus that permits the aerosol to be efficiently delivered.

Consumables comprising tobacco for use with aerosol generating articles are known. Such devices are typically heat-not-burn type devices in which the tobacco is heated to a temperature sufficient to cause release of an aerosol without combusting the tobacco. Because the tobacco is not combusted, aerosol forming compounds such as glycerol may enhance aerosol production at lower temperatures.

A substantial amount of tobacco is often used in heat-not-burn aerosol generating articles. In part, this is because the tobacco is often not completely consumed.

It would be desirable to provide a consumable for use in an aerosol generating device where the consumable contains a reduced amount of tobacco, while delivering a taste and experience of consumables having higher tobacco content.

In various aspects of the present invention there is provided a cartridge for use with an aerosol generating device. The cartridge comprises a housing and an aerosol-forming substrate disposed in the housing. The aerosol-forming substrate comprises a first portion comprising plant material, in particular, tobacco and a second portion adjacent the first portion. The second portion comprises a gel. The gel comprises an aerosol former. The plant material preferably comprises plant material powder, in particular, tobacco powder.

The tobacco powder may comprise the majority of the first portion. Having a high percentage of tobacco powder, as opposed to, for example, a small percentage in a gel, provides for ease of manufacture and flexibility. In addition or alternatively, a mixture in a gel may present compatibility issues and may affect shelf-life.

The housing may be adapted to receive heat from, for example, a heating element of an aerosol generating device, with which the cartridge may be used. Upon heating, the gel in the second portion melts and forms a mixture with the plant material, in particular, tobacco powder in the adjacent first portion. When sufficiently heated, the mixture may form an aerosol comprising volatilized plant material, in particular, tobacco constituents. Preferably, the housing is heated to an extent sufficient to cause aerosol formation without combusting the aerosol-forming substrate or components of the aerosol forming substrate.

In some embodiments, the housing comprises an open end and a closed end and defines an aperture between the closed end and the open end. The aerosol-forming substrate may be disposed in the housing in proximity to the closed end. The cartridge may further comprise flow control apparatus disposed in the housing. The flow control apparatus comprises a proximal end, a distal end, and an internal airflow passageway between the distal end and the proximal end. The proximal end is closer to the open end of the housing than the distal end. The flow control apparatus further comprises a seal between an exterior of the flow control apparatus and an interior of the housing. The seal is between the open end of the housing and the aperture of the housing. In addition, the flow control apparatus comprises a channel between a portion of the exterior of the flow control apparatus and the interior of the housing. The channel is in communication with the aperture and directs air towards the aerosol-forming substrate. The flow control apparatus may enhance the efficiency with which the aerosol is delivered to a user.

Various aspects or embodiments of the cartridges for use with aerosol generating devices described herein may provide one or more advantages relative to currently available or previously described cartridges for aerosol generating devices. For example, the use of tobacco powder and a gel in separate portions provides for ease of manufacture and flexibility, as combining the gel and the tobacco powder in a mixture may present compatibility issues, may affect shelf-life, and the like. In addition, the use of tobacco powder allows for simple manufacture. For example, the need to transform the tobacco powder into a sheet form or a rod form like, for example with a cast-leaf process may be avoided. Further, the aerosol-forming substrates forming separate portions of tobacco powder and aerosol-former gel may allow for more efficient consumption or depletion of the substrate, resulting in reduced amounts of tobacco being used to provide an effect similar to higher tobacco content products. In addition, aerosol production may occur quickly (short time to first puff) upon heating due to the aerosol former in the gel. The use of a gel may also serve to prevent leakage that might occur if a liquid composition were employed. As another example, the flow control apparatus, if employed, may provide for efficient transfer of aerosol. These and other advantages will be readily apparent to those of skill in the art upon reading the disclosure presented herein.

The cartridge of the invention may comprise any suitable aerosol-forming substrate including a first portion comprising tobacco and an adjacent second portion including a gel comprising an aerosol former.

The first portion may comprise tobacco and one or more optional additional ingredients. Preferably, the tobacco comprises tobacco powder. As used herein, "tobacco powder" is a particulate material produced from material of a tobacco plant. Preferably, the particulate material forming the tobacco powder has a mean size of between about 0.01 millimetres and about 2 millimetres, More preferably, the particular material forming the tobacco powder has a mean size of between about 0.015 millimetres and about 0.12 millimetres. In some embodiments, the tobacco powder comprises an agglomeration of particles having a mean size of between about 0.02 millimetres and about 0.08 millimetres, where the agglomerated particles have a mean size greater than the individual particles that are included in the agglomerated particles.

The plant material, in particular, tobacco powder may include material from any suitable part of a tobacco plant, such as the leaves, the stems, the lamina, the midribs, and the stalks. The plant, or a suitable portion of the plant, in particular the tobacco plant, may be ground, crushed, pulverized, milled, disintegrated, or otherwise be processed into particulate material to produce tobacco powder.

The tobacco powder may be the only tobacco, or may include the majority of the tobacco, used in a portion of the aerosol-forming substrate, or in the entire aerosol-forming substrate, in the cartridges of the present invention.

The tobacco powder may include a blend of one or more types of tobacco. As used herein, a "type of tobacco" or a "tobacco type" means a variety of tobacco. Different tobacco varieties may be distinguished in three main groups of bright tobacco, dark tobacco and aromatic tobacco.

The distinction between these three groups may be based on the curing process the tobacco undergoes before it is further processed in a tobacco product.

Bright tobaccos are tobaccos with generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio, From a sensorial perspective, bright tobacco is a tobacco type which, after curing, is associated with a spicy and lively sensation. Bright tobaccos typically have a content of reducing sugars of between about 2.5 percent and about 20 percent on dry weight basis of the leaf and a total ammonia content of less than about 0.12 percent on dry weight basis of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

In some preferred embodiments, the tobacco powder comprises at least about 30 percent of bright tobacco in dry weight basis of total amount of tobacco in the blend; between about 0 percent and about 40 percent of dark tobacco in dry weight basis of total amount of tobacco in the blend; and between about 0 percent and about 40 percent of aromatic tobacco in dry weight basis of total amount of tobacco in the blend.

The tobacco powder may also comprise filler tobacco. Filler tobaccos are not specific types of tobacco but include tobacco types that are mostly used to complement the other tobacco types used in a blend and typically do not bring a specific characteristic aroma direction to the final produce. Examples for filler tobaccos are stems, midrib or stalks of other tobacco types. A specific example may be flue cured stems of Flue Cured Brazil lower stalk.

Within each type of tobaccos, the tobacco leaves may be further graded for example with respect to origin, position in the plant, colour, surface texture, size and shape. These and other characteristics of the tobacco leaves may be used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

Different grades within the same tobacco type may be cross-blended to reduce the variability of each blend component. The different tobacco grades may be selected to realize a desired blend having specific predetermined characteristics. For example, the blend may have a target value of reducing sugars, total ammonia and total alkaloids per dry weight base of the homogenized tobacco material, Total alkaloids are for example nicotine and the minor alkaloids including nornicotine, anatabine, anabasine and myosmine.

The tobacco powder may be produced in any suitable manner. In some embodiments, the tobacco powder is produced by a process that includes coarse grinding of the tobacco and fine grinding of the coarsely ground tobacco. The tobacco may be ground as described in, for example, Published PCT Patent Application WO2016/050469A1.

If more than one type of tobacco is used, the types of tobacco may be mixed at any suitable point in the process. For example, the types of tobacco may be mixed prior to coarse grinding or after coarse grinding but before fine grinding. Alternatively or in addition, the types of tobacco may be mixed after fine grinding.

In some embodiments, at least 95 percent of the ingredients of the tobacco powder are known. This is a substantial advantage over conventional tobacco powder used in reconstituted tobacco sheets, where the exact composition of the tobacco dust that is used for the preparation is not entirely known. The blending of the tobaccos for the production of the tobacco powder therefore allows setting and meeting predetermined target values for certain characteristics of the resulting blend of different types of tobacco, such as, for example, the flavour characteristics, Preferably, the starting material for the production of tobacco powder mostly tobacco leaf that has thus the same size and physical properties as the tobacco for the blending of cut filler that is tobacco leaves.

Preferably, the tobacco powder contains only small amounts, for example less than about 5 percent in dry weight basis of total amount of tobacco in the blend, of the leftovers of other tobacco production processes. Advantageously, the tobacco blend is a blend of different tobacco types and grades which is obtained in an analogous manner as in the cigarette blending process. In particular, this means that different types of tobacco are selected to obtain the desired specific blend having certain specific predetermined characteristics. For example, selected characteristics can be one or more of reducing sugar, total ammonia and total alkaloids in the tobacco blend.

The tobacco powder may also include to some extent dust produced as a side product from processing of tobacco material, such as from handling and processing of tobacco leaves in the manufacture of tobacco products. Preferably, the plant material comprises less than 5 percent of the weight of plant material, of tobacco dust that is produced as a by-product from processing of tobacco material.

The first portion of the aerosol-forming substrate that comprises the tobacco powder may comprise one or more intrinsic binders, one or more extrinsic binders, or a combination thereof to help agglomerate particles of tobacco. For example, the first portion of the aerosol-forming substrate that comprises the tobacco powder may comprise from about 1 percent to about 5 percent in dry weight basis of the tobacco. Although any binder may be employed, preferred binders are natural pectins, such as fruit, citrus or tobacco pectins; guar gums; such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullulan; konjac flour; xanthan gum and the like.

The first portion may comprise other additives including, but not limited to, tobacco and non-tobacco fibres, aerosol-formers, humectants, plasticisers, flavourants, fillers, aqueous and non-aqueous solvents, and combinations thereof.

The first portion may optionally comprise an aerosol-former. The aerosol-former, if present, may be present in any suitable amount, such as between about 5 percent and about 30 percent, preferably between about 8 percent and about 25 percent, preferably, between about 10 percent and about 22 percent by weight on a dry weight basis. Suitable aerosol-formers are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di-, or polycarboxylic acids, such as dimethyl dodecanedioate and dimethyl tetradecanedioate. In preferred embodiments, the first portion comprises glycerol as an aerosol-former. Separating the aerosol former from the plant material powder may be advantageous as a mixture of aerosol former and the plant material powder may become sticky or otherwise difficult to handle in production.

The aerosol-forming substrate included in the cartridges of the invention comprises a second portion adjacent to the first portion that comprises the tobacco. The second portion comprises a gel comprising an aerosol-former.

The gel may comprise any suitable aerosol-former. The aerosol-former may be any suitable known compound or mixture of compounds that, in use, facilitates formation of a dense and stable aerosol and that is substantially resistant to thermal degradation at an operating temperature of the gel when the cartridge is used with an aerosol-generating device configured to heat the cartridge. Suitable aerosol-farmers include: polyhydric alcohols, such as triethylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerol. In a particularly preferred embodiment, the gel comprises as aerosol former only glycerol.

The gel may include any suitable amount of aerosol-former. Preferably, the gel includes from about 50 percent by weight to about 95 percent by weight of the aerosol-former. For example, the gel may comprise glycerol in an amount from about 50 percent by weight to about 95 percent by weight, such as from about 65 percent to about 70 percent by weight.

The gel may include any suitable amount of water. Preferably, the gel comprises an amount of water that is less than about 40 percent by weight of the gel, such as less than about 30 percent by weight of the gel. In some embodiments, the gel comprises from 0 percent to about 5 percent water by weight. In some embodiments, the gel comprises from about 20 percent to about 40 percent water.

Preferably, the combined weight of water and aerosol-former in the gel is in a range from about 90 percent by weight to about 98 percent by weight.

The gel includes a gelling agent. The gelling agent may form a solid medium in which the aerosol-former may be dispersed.

The gel may include any suitable gelling agent. For example, the gelling agent may include one or more biopolymers, such as two or three biopolymers. Preferably, where the gel includes more than one biopolymer, the biopolymers are present in substantially equal weights.

The biopolymers may be formed of polysaccharides. Biopolymers suitable as gelling agents include, for example, gellan gums (native, low acyl gellan gum, high acyl gellan gums with low acyl gellan gum being preferred), xanthan gum, alginates (alginic acid), agar, guar gum, and the like. Preferably, the gel comprises agar.

The gel may include any suitable amount of gelling agent. For example, the gel comprises the gelling agent in a range from about 0.5 percent by weight to about 7 percent by weight of the gel. Preferably, the gel comprises the gelling agent in a range from about 1 percent by weight to about 5 percent by weight, such as from about 1.5 percent by weight to about 2.5 percent by weight.

In some preferred embodiments, the gel comprises agar in a range from about 0.5 percent by weight to about 7 percent by weight, or in a range from about 1 percent by weight to about 5 percent by weight, or about 2 percent by weight.

In some preferred embodiments, the gel comprises xanthan gum in a range from about 2 percent by weight to about 5 percent by weight, or in a range from about 2 percent by weight to about 4 percent by weight, or about 3 percent by weight.

In some preferred embodiments, the gel comprises xanthan gum, gellan gum, and agar. The gel may include xanthan gum, low acyl gellan gum, and agar. The gel may include xanthan gum, gellan gum, and agar in substantially equal weights. The gel may include xanthan gum, low acyl gellan gum, and agar in substantially equal weights. The gel may include xanthan gum, low acyl gellan gum, and agar in a range from about 1 percent by weight to about 5 percent by weight (for the total weight of xanthan gum, low acyl gellan gum, and agar in the gel), or in a range from about 1 percent by weight to about 4 percent by weight, or about 2 percent by weight. The gel may include xanthan gum, low acyl gellan gum, and agar in a range from about 1 percent by weight to about 5 percent by weight, or about 2 percent by weight, where xanthan gum, gellan gum, and agar are substantially equal weights.

The gel may comprise a divalent cation. Preferably the divalent cation includes calcium ions, such as calcium lactate in solution. Divalent cations (such as calcium ions) may assist in the gel formation of compositions that include biopolymers (polysaccharides) such as, gellan gums (native, low acyl gellan gum, high acyl gellan gums), xanthan gum, alginates (alginic acid), agar, guar gum, and the like. The ion effect may assist in the gel formation. The divalent cation may be present in the gel composition in a range from about 0.1 to about 1 percent by weight, or about 0.5 percent wt. In some embodiments, the gel does not include a divalent cation.

The gel may comprise a carboxylic acid. The carboxylic acid may include a ketone group. Preferably, the carboxylic acid includes a ketone group that has less than 10 carbon atoms. Preferably, this carboxylic acid has five carbon atoms (such as levulinic acid). Levulinic acid may be added to the neutralize the pH of the gel. This may also assist in the gel formation that includes biopolymers (polysaccharides) such as, gellan gums (low acyl gellan gum, high acyl gellan gums), xanthan gum, especially alginates (alginic acid), agar, guar gum, and the like. Levulinic may also enhance a sensory profile of the gel formulation. In some embodiments, the gel does not include a carboxylic acid.

The gel may optionally comprise nicotine, a tobacco extract, for example a liquid tobacco extract, a flavourant, and combinations thereof.

The gel may comprise any suitable amount of nicotine. The term "nicotine" refers to nicotine and nicotine derivatives such as free-base nicotine, nicotine salts and the like. For example, the gel may comprise from about 1 percent to about 5 percent nicotine by weight, such as from about 1.5 percent to about 2.5 percent nicotine by weight. Because the tobacco in the first portion may comprise nicotine, the gel may, in some embodiments, not include nicotine.

The gel may include one or more sensory-enhancing agents. Any suitable sensory-enhancing agent may be included in the gel. Suitable sensory-enhancing agents include flavorants and sensation agents. Suitable flavorants include aromatic or fragrance molecule as conventionally used in the formulation of flavoring or fragrance compositions. Preferably, the flavorant is an aromatic, terpenic or sesquiterpenic hydrocarbon. The flavorant may be an essential oil, alcohol, aldehyde, phenolic molecule, carboxylic acid in their various forms, aromatic acetal and ether, nitrogenous heterocycle, ketone, sulfide, disulfide and mercaptan which may be aromatic or non-aromatic. Examples of flavoring agents include natural or synthetic aromas or fragrances. Suitable sensation agents include freshening agents, cooling agents, or hot effect agents, which respectively provide a freshening or cooling effect or a hot effect respectively. Suitable freshening agents may be, but are not limited to, menthyl succinate and derivatives thereof. A suitable hot effect agent may be, but is not limited to, vanillyl ethyl ether.

Other examples of suitable sensory-enhancing agents that may be included in the gel include 2-3 dimethyl pyrazine, ethyl butyrate, ethyl maltol, ethyl propionate, furaneol, isobutyraldehyde, isovaleric acid, maltol, benzaldehyde, dimethyl sulphide, 2 methyl butyric acid, isovaleraldehyde, phenethyl alcohol, phenylacetic acid, heliotropine, valeric acid, valeraldehyde, butyl alcohol, butyric acid, benzyl alcohol, ethyl acetate, isobutyl alcohol, isobutyric acid, cyclotene, coffee dione, acetoin, sorbitol, ethyl lactate, citric acid, alpha ionone, lactic acid, and pyruvic acid.

In some embodiments, the sensory-enhancing agent includes one or more of tobacco flavor, menthol, wintergreen, peppermint, herb flavors, fruit flavors, nut flavors, liquor flavors, and combinations thereof.

The gel may comprise one or more tobacco extracts as a sensory-enhancing agent. The tobacco extracts preferably enhance the tobacco flavour of the aerosol-forming substrate. Because the tobacco in the first portion of the aerosol-forming substrate is preferably not combusted, the flavour profile produced by the aerosol-forming substrate of the present invention may differ from a smoking article that includes tobacco that is combusted during use, such as a cigarette. Thus, the addition of one or more tobacco extracts to the gel may advantageously alter the sensory profile of the aerosol-forming substrate in the cartridges of the present invention.

The gel may comprise any suitable amount of one or more sensory-enhancing agents. For example, the gel may comprise one or more sensory-enhancing agents in an amount from about 0.01 percent to about 15 percent by weight, such as from about 1 percent to about 12 percent by weight, about 2 percent to about 10 percent by weight, or about 5 percent to about 8 percent by weight. In some embodiments, the gel does not comprise a sensory-enhancing agent.

The gel may be the only material, or may comprise the majority of the material, in the second portion of the aerosol-forming substrate in the cartridges of the present invention.

The first portion comprising the tobacco and the adjacent second portion comprising the gel may be arranged in the housing of the cartridge in any suitable arrangement. The materials of the first and second portion preferably are in contact with one another. Preferably, the tobacco of the first portion contacts the gel of the second portion. In some preferred embodiments, the first portion consists of, or consists essentially of, tobacco powder, or tobacco powder comprises the majority of the first portion; and the second portion consists of, or consists essentially of, the gel; and the gel contacts the tobacco powder.

In some embodiments, the first and second portions may be arranged substantially parallel to a longitudinal axis of the housing or may be arranged substantially perpendicular to the longitudinal axis of the housing.

Where the housing comprises an open end and a closed end, preferably, the aerosol-generating substrate may be disposed in proximity to the closed end of the housing. The first portion may be disposed closer to the closed end than the second portion, or the second portion may be disposed closer to the closed end than the first portion. In some embodiments, the first portion and the second portion each extend from the closed end towards the open end.

In some embodiments, the first portion surrounds at least a portion of the second portion, or the second portion surrounds at least a portion of the first portion. For example, the first portion may comprise an interior opening in which the second portion is disposed, or the second portion may comprise an interior opening in which the first portion is disposed.

In some embodiments, the aerosol-forming substrate comprises a plurality of first portions, a plurality of second portions, or a plurality of first and second portions. The first and second portions may be alternated. The alternating first and second portions may be stacked on each other. For example, the first and second alternating portions may be stacked perpendicular to a longitudinal axis of the housing of the cartridge in which the portions are disposed. The first and second alternating portions may be stacked parallel to a longitudinal axis of the housing of the cartridge in which the portions are disposed. The first and second portions may be arranged such that they are adjacent to one another and alternating in a direction from the exterior of the housing towards a central interior of the housing. For example, the alternating first and second portions may be stacked in a concentric manner.

In some preferred embodiments, the aerosol-forming substrate comprises a first portion disposed between two second portions.

The aerosol-forming substrate disposed in the housing of the cartridge may include any suitable amount of gel and plant material, in particular tobacco. In some embodiments, the total weight of plant material, in particular tobacco in the aerosol-forming substrate is from about 10 milligrams to about 100 milligrams. Preferably, the total weight of plant material, in particular tobacco in the aerosol-forming substrate is from about 10 milligrams to about 50 milligrams. More preferably, the total weight of plant material, in particular tobacco in the aerosol-forming substrate is from about 20 milligrams to about 40 milligrams, such as about 30 milligrams.

Such amounts of plant material, in particular tobacco are substantially smaller than the amount of tobacco used in currently available heat-not-burn consumables.

In some preferred embodiments, the cartridges of the present invention when used with a suitable aerosol generating device deliver a number of puffs similar to that generated with Philip Morris International's HEETS® or Heatstick® articles for use in Philip Morris International's iQOS™ aerosol generating device system. By way of example, the cartridges of the present invention preferably deliver 8 to 12 puffs prior to the tobacco being consumed.

The aerosol-forming substrate disposed in the housing of the cartridge may include any suitable amount of gel. In some embodiments, the total weight of gel in the aerosol-forming substrate is from about 50 milligrams to about 500 milligrams. Preferably, the total weight of tobacco in the aerosol-forming substrate is from about 100 milligrams to about 400 milligrams. More preferably, the total weight of tobacco in the aerosol-forming substrate is from about 150 milligrams to about 250 milligrams, such as about 200 milligrams.

Regardless of the actual manner in which the first and second portions of the aerosol-forming substrate are disposed in the housing and the total amount of gel and tobacco in the aerosol-forming substrate, the portions are preferably positioned such that heating of the housing causes the gel in the one or more second portions to melt and form a mixture with the tobacco in the first portion. Upon melting of the gel, the aerosol-former may mix with the tobacco and facilitate formation of a dense and stable aerosol that includes volatile tobacco constituents.

The cartridge may be received by an aerosol generating device. The aerosol generating device may comprise a heating element configured to heat the housing to cause the gel to melt and the aerosol to form.

The cartridge may include a mouth end and a distal end that may be received by an aerosol generating device having a heating element configured to heat the distal end of the cartridge. The aerosol-forming substrate may be disposed in proximity to the distal end of the cartridge. The aerosol generating device may heat the aerosol forming substrate in the cartridge to generate an aerosol comprising volatile tobacco constituents.

The cartridge, or portions of the cartridge, containing the aerosol-forming substrate may be single-use cartridges or multi-use cartridges. In some embodiments, portions of the cartridges are re-usable, and portions are disposable after a single use. For example, the cartridges may include a mouthpiece that may be re-usable and a single use portion that contains the aerosol-forming substrate. In embodiments comprising both reusable portions and single use portions, the reusable portions may be removable from the single use portions.

The cartridge includes a housing. The housing may comprise a single part or multiple parts. The housing may define an open end and a closed end. The aerosol-forming substrate may be disposed in proximity to the closed end. In some embodiments, the open end of the housing may serve as a mouthpiece. The housing may define at least one aperture between the open end and the closed end. The at least one aperture defines at least one air inlet, such that when a negative pressure is applied on the open end of the housing, air enters the housing through the aperture.

The cartridge may include flow control apparatus disposed in the housing. The flow control apparatus may comprise a proximal end, a distal end, and an internal airflow passageway between the distal end and the proximal end. The proximal end may be closer to the open end of the housing than the distal end. A seal may be formed between an exterior of the flow control apparatus and an interior of the housing. Preferably, the seal is between the open end of the housing and the aperture of the housing. A channel may be formed between a portion of the exterior of the flow control apparatus and the interior of the housing. The channel may be in communication with the aperture and may direct air towards the aerosol-forming substrate. That is, when a negative pressure is applied at the mouth end of the housing, air is drawn into the housing through the aperture and may flow along the channel towards the aerosol-forming substrate at the distal end, then through an internal airflow passageway of the flow control apparatus from the distal end to the proximal end and out of the cartridge at the open end user.

The internal airflow passageway of the flow control apparatus may provide air and aerosol generated from the aerosol-forming substrate with a pathway to be drawn out of the housing through the open end. The pathway provided by the airflow passageway of the flow control apparatus may have an airflow cross section that is constant or varied along the length of the passageway. This may improve the flow of aerosol generated from the aerosol-forming substrate from the closed end of the housing to the open end of the housing. That is, the cross-sectional area normal to the longitudinal axis of the pathway, may vary along the length of the pathway.

In some embodiments, the airflow cross section of the airflow passageway may be substantially constant from the distal end to the proximal end. The airflow passageway may have any suitable inner diameter. For example, the inner diameter of the airflow passageway may be between about 1 mm to about 5 mm, such as about 2 mm. The airflow passageway typically has an airflow cross section that is smaller than the airflow cross section within the housing around the distal end of the flow control apparatus. As such, the flow control apparatus presents a constricted airflow cross section for accelerating air entering the airflow passageway at the distal end.

In some embodiments, the airflow cross section of the airflow passageway may vary from the distal end to the proximal end. For example, the airflow cross section at the distal end of the airflow passageway may be greater than the airflow cross section at the proximal end of the airflow passageway. Where the airflow cross section of the airflow passageway is greater at the distal end than at the proximal end, the diameter of the airflow passageway at the proximal end may be between about 0.5 mm to about 3 mm, such as about 1 mm, and the diameter of the airflow passageway at the distal end may be between about 1 mm to about 5 mm, such as about 2 mm.

The flow control apparatus may have any suitable length. For example, the flow control apparatus may have a length from about 3 mm to about 50 mm, such as from about 4 mm to about 30 mm, such as about 25 mm.

The internal airflow passageway of the flow control apparatus may have one or more portions arranged between the distal end and the proximal end that are adapted to control the flow of air through the airflow passageway from the distal end to the proximal end.

The airflow passageway of the flow control apparatus may comprise a first portion between the proximal end and the distal end that is configured to accelerate air as it flows from the distal end towards the proximal end of the flow control apparatus. The first portion of the airflow passageway may be configured in any suitable manner to accelerate air as it flows through the airflow passageway from the distal end towards the proximal end of the airflow passageway. For example, the first portion of the airflow passageway may include guides defining a constricted airflow cross section, which force air to accelerate substantially in the axial direction from the distal end towards the proximal end.

In some embodiments, the airflow cross section of the first portion of the airflow passageway may constrict from a location closer to the distal end of the flow control apparatus to a location closer to the proximal end of the flow control apparatus to cause the air to accelerate as it flows from the distal end towards the proximal end. In other words, the airflow cross section of the first portion may constrict from the distal end of the first portion to the proximal end of the first portion. Preferably, the distal end of the first portion of the airflow passageway (the location closer to the distal end of the flow control apparatus) has an inner diameter greater than the proximal end of the first portion (the location closer to the proximal end of the flow control apparatus).

In some embodiments, the airflow cross section of the first portion of the airflow passageway may be substantially constant from the distal end of the first portion to the proximal end of the first portion. In such embodiments, the substantially constant airflow cross section of the first portion of the airflow passageway may be smaller than the airflow cross section at the distal end of the airflow passageway.

For purposes of the present disclosure, "diameter" or "width" is the maximum transverse dimension of the cartridge or a portion or a part of the cartridge. By way of example, the "diameter" is the diameter of an object having a circular cross-section or is the length of a diagonal of an objection having a rectangular transverse cross-section.

For purposes of the present disclosure, an airflow cross section that is "constricted" from a first location to a second location means that the airflow cross section reduces in diameter from the first location to the second location.

Where the airflow cross section of the first portion of the airflow passageway is constricted from the distal end to the proximal end, the constriction of the airflow cross section typically comprises a reduction in the diameter of the airflow passageway from the distal end of the first portion to the proximal end of the first portion. The constriction of the airflow cross section from the distal end to the proximal end may be continuous. For example, the reduction in the diameter of the airflow passageway may be linear from the distal end to the proximal end of the first portion. The constriction may be uniform or non-uniform. For example, the rate of constriction of the airflow cross section may increase from the distal end to the proximal end of the first portion. The constriction of the airflow cross section may be stepped. In other words, the airflow cross section may constrict in discrete increments or steps from the distal end to the proximal end. In some embodiments, the constriction is linear and uniform around the circumference of the airflow passageway from the distal end to the proximal end of the first portion.

The first portion (the air accelerating portion) of the airflow passageway may have any suitable shape. An inner surface of the flow control apparatus defining the first portion (the air accelerating portion) of the airflow passageway may have a frustoconical shape.

The proximal end of the first portion of the airflow passageway may have any suitable inner diameter. For example, the inner diameter of the proximal end of the first portion of the airflow passageway may be between about 0.5 mm to about 3 mm, such as about 1 mm.

The distal end of the first portion of the airflow passageway may have any suitable inner diameter. For example, the inner diameter of the distal end of the first portion of the airflow passageway may be between about 1 mm to about 5 mm, such as about 2 mm.

The ratio of the diameter of the proximal end of the first portion of the airflow passageway to the diameter of the distal end of the first portion of the airflow passageway may be any suitable ratio. For example, the ratio may be between about 1:4 and about 3:4, or between about 2:5 and about 3:5, or may be about 1:2.

The first portion of the airflow passageway may have any suitable length. In other words, the distance between the proximal end and the distal end of the first portion of the airflow passageway may be any suitable distance. For example, the length of the first portion of the airflow passageway may be from about 3 mm to about 15 mm, such as from about 4 mm to about 7 mm, or about 5.5 mm.

The internal airflow passageway of the flow control apparatus may optionally comprise a second portion closer to the proximal end of the flow control apparatus than the first portion. In other words, the second portion may be arranged downstream of the first portion. The second portion of the airflow passageway may be configured to decelerate air flowing from the distal end towards the proximal end of the flow control apparatus. The airflow cross section of the second portion of the airflow passageway may expand from a location closer to the distal end of the flow control apparatus to a location closer to the proximal end of the flow control apparatus to cause the air to decelerate as it flows from the distal end towards the proximal end. In other words, the second portion of the airflow passageway may comprise a distal end and a proximal end and the airflow cross section of the second portion may expand from the distal end to the proximal end. Thus, the location closer to the proximal end may have an inner diameter that is greater than the diameter closer to the distal end.

For purposes of the present disclosure, an airflow cross section that is "expanded" from a first location to a second location means that the airflow cross section increases in diameter from the first location to the second location.

The expansion of the airflow cross section from the distal end of the second portion of the airflow passageway to the proximal end of the airflow passageway may be continuous. The expansion may be uniform or non-uniform. For example, the expansion may be stepped. For example, the expansion may be linear. For example, the rate of expansion of the airflow cross section may increase from the distal end to the proximal end of the first portion. In some embodiments, the expansion is continuous and uniform from the location closer to the distal end to the location closer to the proximal end.

The second portion (the air decelerating portion) of the airflow passageway may have any suitable shape. An inner surface of the flow control apparatus defining the second portion (the air decelerating portion) of the airflow passageway may have a frustoconical shape.

The proximal end of the second portion of the airflow passageway may have any suitable inner diameter. For example, the inner diameter of the proximal end may be between about 2 mm to about 6 mm, such as between about 3 mm to about 5.5 mm, such as about 5 mm.

The distal end of the second portion of the airflow passageway may have any suitable inner diameter. In some embodiments, the distal end of the second portion may have the same diameter as the distal end of the first portion. For example, the inner diameter of the distal end of the second portion may be between about 0.5 mm to about 3 mm, such as about 1 mm. In some embodiments, the distal end of the second portion may have a different diameter to the proximal end of the first portion. For example, the inner diameter of the distal end may be between about 1 mm to about 6 mm, such as between about 2 mm to about 5 mm, such as about 4.2 mm.

The second portion of the airflow passageway, if present, may have any suitable length. For example, the second portion of the airflow passageway may have a length from about 0.2 mm to about 20 mm, such as from about 1 mm to about 10 mm, such as between about 3 mm and about 7 mm, such as about 4.5 mm.

In some embodiments, the internal airflow passageway of the flow control apparatus may optionally comprise a third portion closer to the distal end of the flow control apparatus than the first portion. In other words, the third portion may be arranged upstream of the first portion.

The third portion may comprise a chamber having a substantially constant inner diameter along its length, relative to the first and optional second portions. The third portion may provide a chamber to enable cooling of the air, vapour and aerosol before it reaches the air accelerating portion. The third portion may also provide additional control of the resistance to draw RTD of the flow control apparatus.

The third portion may have a substantially constant inner diameter of between about 2 mm and about 6 mm, such as about 5 mm or in particular about 4.8 mm or about 5.1 mm. The third portion may have a distal end closer to the distal end of the flow control apparatus and a proximal end closer to the proximal end of the flow control apparatus. In some embodiments, the third portion may be slightly tapered from the distal end to the proximal end. For example, the inner diameter at the distal end of the third portion may be about 5.1 mm and the distal portion at the proximal end of the third portion may be about 4.8 mm. A slight taper of the inner diameter from the distal end to the proximal end may facilitate manufacture of the flow control apparatus.

The third portion of the airflow passageway may have any suitable length. For example, the third portion of the airflow passageway may have a length of between about 1 mm and about 50 mm, such as between about 5 mm and about 30 mm or about 15 mm.

In some embodiments, the airflow passageway of the flow control apparatus is defined by a first portion only. In some embodiments, the airflow passageway of the flow control apparatus comprises a first portion and a second portion closer to the proximal end of the flow control apparatus than the first portion (that is, downstream of the first portion). In some embodiments, the airflow passageway of the flow control apparatus comprises a first portion, a second portion closer to the proximal end of the flow control apparatus than the first portion (that is, downstream of the first portion) and a third portion closer to the distal end of the flow control apparatus than the first portion (that is, upstream of the first portion).

The cartridge may comprise a seal between an exterior of the flow control apparatus and an interior of the housing. If the housing and the flow control apparatus, or portions of the housing, are formed from the same part, the seal may be formed by the integration of the components into the single part. If the housing and the flow control apparatus are formed from separate parts, the seal may be formed by, for example, an interference fit of the flow control apparatus in the housing. In particular, the seal may be formed by an interference fit at between a proximal portion of the exterior of the flow control apparatus and an interior of the housing. A gasket, such as an O-ring, between the housing and the flow control apparatus may be employed to form the seal or assist in forming the seal. The seal is located between the open end of the housing and the at least one aperture.

In some embodiments, the flow control apparatus is removably secured to the housing. For example, the flow control apparatus may be received in the housing by interference fit, threaded engagement, or the like, such that the flow control apparatus may be securely inserted and removed from the housing without damaging the housing or the flow control apparatus. Secure insertion of the flow control apparatus in the housing may produce a seal between the flow control apparatus and the housing.

The cartridge comprises at least one channel in communication with an aperture of the housing. The channel is formed, at least in part, by the housing. The channel directs air from the aperture towards the aerosol-forming substrate. In some embodiments, the channel is formed between an exterior surface of the flow control apparatus and an interior surface of the housing.

The cartridge may comprise more than one channel. In some embodiments, the cartridge comprises from about 2 to about 20 channels between the outer surface of the flow control apparatus and the inner surface of the housing. For example, the cartridge may comprise from about 5 to about 15 channels, such as from about 10 to 12 channels.

Preferably, each channel is in communication with at least one aperture through the housing. However, the cartridge may comprise one or more channels that are not in direct communication with an aperture.

The aperture may be positioned at any suitable location of the housing. In some embodiments, the housing may comprise more than one apertures. For example, the housing may comprise from about 2 to about 20 apertures. The number of apertures may be equal to the number of channels. If the number of apertures is equal to the number of channels, each aperture may correspond to a separate channel. If the housing comprises more than one aperture, the apertures may be arranged in any suitable manner. Preferably, the apertures are circumferentially disposed around the housing. The apertures may be disposed circumferentially around the housing, and the may be spaced from the closed end of the housing by the same distance.

The channels may comprise sidewalls. Preferably, the sidewalls extend the length of the channel.

In some embodiments, the sidewalls extend between an exterior of the flow control apparatus and the interior of the housing. The sidewalls may extend from the exterior of the flow control apparatus, the interior of the housing, or the exterior of the flow control apparatus and the interior of the housing. The sidewalls may be formed from the same part as the exterior of the flow control apparatus or the interior of the housing.

The channels may have any suitable width. For example, a channel may extend fully around the interior of the housing. The channel may extend less than fully around the housing, such as less than about 90 percent around the housing, less than about 70 percent around the housing, or less than about 50 percent around the housing. In some embodiments, the channel extends at least about 2 percent around the housing, such as at least about 5 percent around an inner surface of the housing.

The channels may have a distal end spaced from the closed end of the housing. The distal end of the channels may be at the distal end of the flow control apparatus. The distal end of a channel may be any suitable distance from the closed end of the housing. For example, the distal end of the channel may be from about 2 mm to about 20 mm from the closed end of the housing, such as from about 7 mm to about 17 mm from the closed end of the housing, or about 15 mm from the closed end of the housing.

Where a channel has sidewalls, the channel may have a width defined by the distance between the side walls. The channels may have any suitable width. For example, the width of the channels may vary from about 0.5 to about 2 mm, such as from about 0.75 mm to about 1.5 mm, such as about 1.5 mm.

A channel may have a depth defined from the inner surface of the housing to the outer surface of the flow control apparatus. The channels may have any suitable depth. The depth of the channel may be constant along the length of the channel. The depth of the channel may vary along the length of the channel. In some embodiments, the depth of the channel increases from a location in proximity to the aperture to a distal end of the channel, which is the end of the channel closest to the closed end of the housing. For example, the outer surface of the flow control apparatus defining the channel may be inwardly tapered from the location in proximity to the aperture to the distal end of the channel. This may facilitate manufacture of at least one of the flow control apparatus and the housing.

Regardless of whether the depth of the channel is consistent or varies along the length of the channel, the channel may have a depth from about 0.3 mm to about 1.5 mm, such as from about 0.5 mm to about 1 mm, or about 0.75 mm.

The distal end of the flow control apparatus may be positioned a suitable distance from the closed end of the housing such that aerosol generated from the aerosol-forming substrate may be entrained in air that enters the aperture, flows through the channel and through the internal passageway of the flow control apparatus to a user for inhalation when the user draws on the cartridge. Preferably, at least 5 percent of the air that flows through the cartridge contacts the aerosol-forming substrate. More preferably, at least 25 percent of the air that flows through the cartridge contacts the aerosol-forming substrate.

In some embodiments, the distal end of the flow control apparatus is positioned from the closed end of the housing a distance from about 2 mm to about 20 mm, such as from about 7 mm to about 17 mm, or about 15 mm.

The cartridge may have any suitable overall dimensions and shape. The cartridge may have a size and shape similar to Philip Morris International's HEETS® or Heatstick® articles, for use in Philip Morris International's iQOS™ aerosol generating device system. Preferably, the cartridge is generally cylindrical. The cartridge may have an outer diameter, for example, from about 5 mm to about 15 mm, such as from about 5 mm to about 10 mm, or from about 7 mm to about 8 mm. The cartridge may have a length, for example, from about 10 mm to about 60 mm, such as from about 50 mm to about 15 mm, such as about 20 mm or about 45 mm.

The cartridges may have any suitable resistance to draw (RTD) and may vary depending on the length and dimensions of the channels, the size of the apertures, the dimensions of the most constricted cross section of the internal passageway, and the like. In many embodiments the RTD of the cartridges is between about 50 and about 140 mm $H_2O$, between about 60 and about 120 mm $H_2O$, or about 90 mm $H_2O$. The RTD of the cartridge refers to the static pressure difference between the one or more apertures and the mouth end of the cartridge when it is traversed by an airflow under steady conditions in which the volumetric flow is 17.5 millilitres per second at the mouth end. The RTD of a specimen can be measured using an appropriately adapted method from the method set out in ISO Standard 6565:2002.

The cartridges may be formed from any suitable one or more materials. For example, the flow control apparatus may be formed from a plastic material, a metal material, a cellulosic material, such as cellulose acetate, paper, cardboard, or combinations thereof. For example, the housing, or a portion of the housing, may be formed from a metal material, a plastic material, cardboard, or combinations thereof. When the housing is formed by cardboard, the apertures may be formed in the cardboard by laser cuts. When the closed end of the housing is formed by cardboard, the end may be closed by folding the cardboard, placing an end cap on a cardboard tube, pinching and folding the cardboard, or the like.

In some embodiments, the cartridge comprises a mouthpiece. The mouthpiece may comprise the flow control apparatus, or a portion thereof, and may form at least a proximal portion of the housing of the cartridge. The mouthpiece may connect with the housing, or a distal portion of the housing, in any suitable manner, such as through interference fit, threaded engagement, or the like.

The aerosol generating substrate may be placed in the housing in proximity to the closed end prior to final assembly of the cartridge. The flow control apparatus, or a part comprising the proximal portion of the housing, which may contain the flow control apparatus, may be connected to the housing or the portion of the housing comprising the closed end.

Once fully assembled, the cartridge defines an airflow path through which air flows when a user draws on the mouth end of the cartridge. When the user draws on the mouth end of the cartridge, air may enter the cartridge through an aperture in the housing, which then may flow through a channel towards the closed end of the housing where it may entrain aerosol generated by heating of the aerosol-forming substrate. The air with entrained aerosol may then flow through the internal passageway of the flow control apparatus and through the open mouth end of the housing.

The cartridge may be configured to be received by an aerosol generating device such that a heating element of the device may heat the housing of the cartridge, such as the closed end of the housing of the cartridge, and thus may heat the aerosol-forming substrate that is disposed in the housing.

The cartridge may be shaped and sized for use with any suitable aerosol generating device comprising a receptacle for receiving the cartridge and a heating element configured and positioned to heat at least a portion of the cartridge, such as the distal end of the cartridge, when the cartridge is received by the aerosol generating device.

The aerosol generating device preferably comprises control electronics operably coupled to the heating element. The control electronics may be configured to control heating of the heating element. The control electronics may be internal to a housing of the device.

The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may comprise a microprocessor, which may be a programmable microprocessor. The electronic circuitry may be configured to regulate a supply of power to the heating element. The power may be supplied to the heating element in the form of pulses of electrical current. The control electronics may be configured to monitor the electrical resistance of the heating element and to control the supply of power to the heating element depending on the electrical resistance of the heating element. In this manner, the control electronics may regulate the temperature of the resistive element.

The aerosol generating device may comprise a temperature sensor, such as a thermocouple, operably coupled to the control electronics to control the temperature of the heating elements. The temperature sensor may be positioned in any suitable location. For example, the temperature sensor may be in contact or in proximity to the heating element. The sensor may transmit signals regarding the sensed temperature to the control electronics, which may adjust heating of the heating element to achieve a suitable temperature at the sensor.

Regardless of whether the aerosol generating device includes a temperature sensor, the device may be configured to heat the aerosol-forming substrate, which is disposed in the cartridge, to an extent sufficient to generate an aerosol.

The control electronics may be operably coupled to a power supply, which may be internal to the housing. The aerosol generating device may comprise any suitable power supply. For example, a power supply of an aerosol generating device may be a battery, or set of batteries. The batteries or power supply unit can be rechargeable, as well as being removable and replaceable. Any suitable battery may be used.

The aerosol generating device may include any suitable heating element. Preferably, the heating element comprises a resistive heating component, such as one or more resistive wires or other resistive elements. The resistive wires may be in contact with a thermally conductive material to distribute heat produced over a broader area. Examples of suitable conductive materials include aluminium, copper, zinc, nickel, silver, and combinations thereof. For purposes of this disclosure, if resistive wires are in contact with a thermally conductive material, both the resistive wires and the thermally conductive material are part of the heating element.

The heating element may be formed in any suitable manner. The heating element may comprise a cavity configured to receive and surround the closed end of the cartridge. The heating element may comprise an elongate element configured to extend along a side of the housing of the cartridge when the closed end of the cartridge is received by the device. In some embodiments, the heating element of the device is an elongate heating element, and an adaptor may be used to transfer heat from the heating element to the cartridge. For example, the adaptor may comprise a cavity configured to receive and surround the cartridge. The adaptor may be formed from thermally conductive material. For example, adaptor may be formed from aluminium, sheet metal, or the like.

In some embodiments, the cartridge may comprise more than one internal sub-cartridges, and each sub-cartridge may comprise a flow control apparatus and housing generally as described above. The sub-cartridges may be retained in an external housing. The cartridge may comprise a manifold to connect the flow control devices of multiple sub cartridges to a single open end of the external housing.

In some embodiments, all of the sub-cartridges may comprise the same aerosol-forming substrate. In some embodiments, one sub-cartridge comprises an aerosol-forming substrate and another sub-cartridge comprises a composition comprising a flavorant.

In some embodiments, the aerosol generating device may be configured to receive more than one cartridge described herein. For example, the aerosol generating device may comprise a receptacle into which an elongate heating element extends. One cartridge may be received in the receptacle on one side of the heating element, and another cartridge may be received in the receptacle on the other side of the heating element.

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1A:
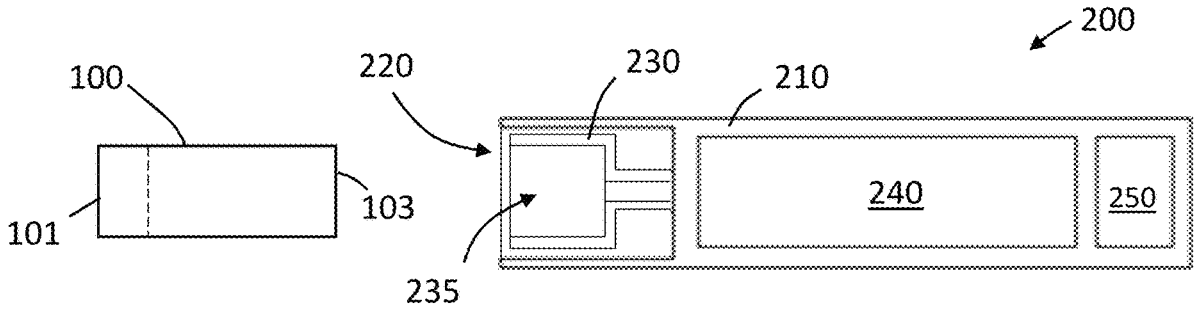
FIG. 1A is a schematic sectional view of an aerosol generating device and a schematic side view of a cartridge that may be inserted into the aerosol generating device.
Figure 1B:
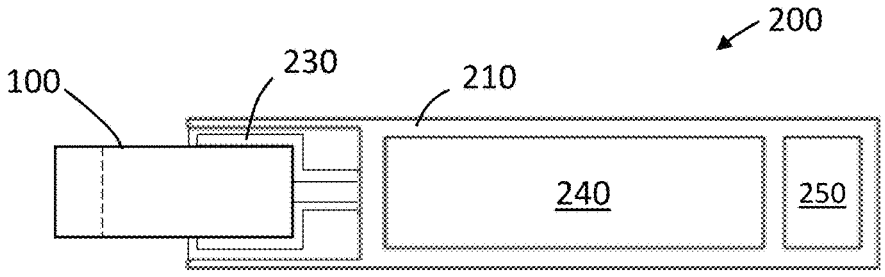
FIG. 1B is a schematic sectional view of the aerosol generating device depicted in FIG. 1A and a schematic side view of the cartridge depicted in FIG. 1A inserted into the aerosol generating device.

FIGS. 1A-B illustrate of an example of a cartridge 100 and aerosol generating device 200. The cartridge 100 has a mouth end 101 and a closed distal end 103. In FIG. 1B, the distal end 103 of the cartridge 100 is received in a receptacle 220 of the device 200. The device 200 includes a housing 210 defining the receptacle 220, which is configured to receive the container 100. The device 200 also includes a heating element 230 that forms a cavity 235 configured to receive the cartridge 100, preferably by interference fit. The heating element 230 may comprise an electrically resistive heating component. In addition, the device 200 includes a power supply 240 and control electronics 250 that cooperate to control heating of heating element 230.

The heating element 230 may heat the distal end 103 of the cartridge 100, which contains an aerosol-forming substrate. Heating of the cartridge 100 causes the aerosol-forming substrate to form an aerosol, which may be drawn through the mouth end 101 of the cartridge 100.

Figure 2A:
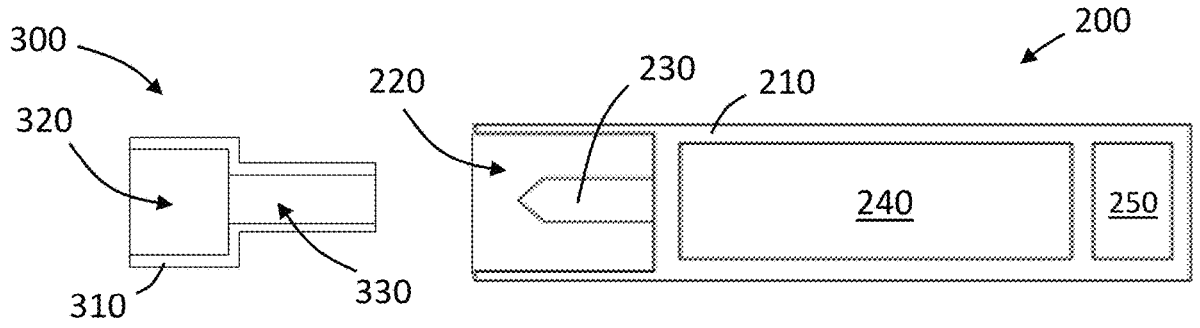
FIG. 2A is a schematic sectional view of an adaptor and an aerosol generating device into which the adaptor may be inserted.
Figure 2B:
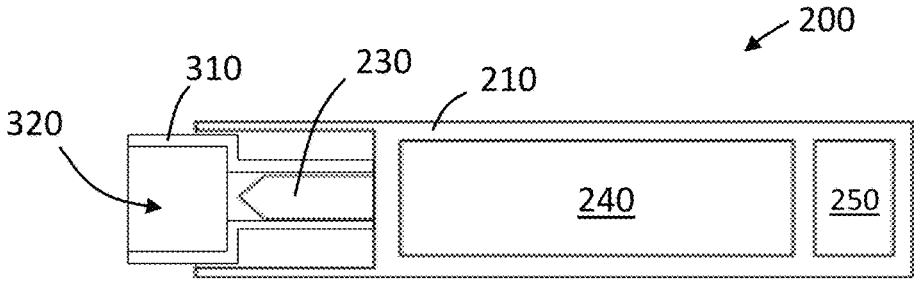
FIG. 2B is a schematic sectional view of the adaptor depicted in FIG. 2A inserted into the aerosol generating device depicted in FIG. 2B.
Figure 2C:
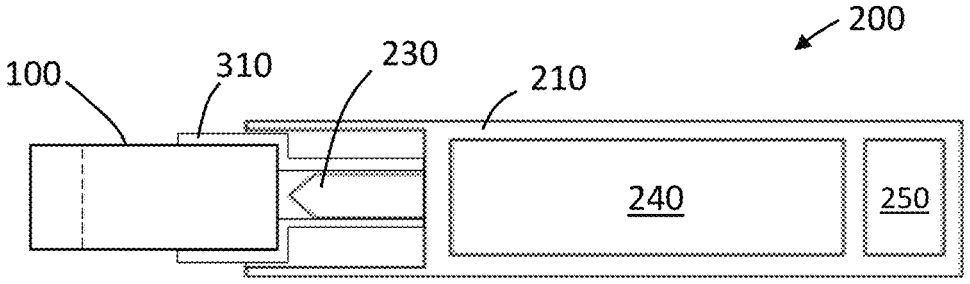
FIG. 2C is a schematic sectional view of the adaptor and aerosol generating device depicted in FIG. 2B and a schematic side view of a cartridge inserted into the adaptor.

FIGS. 2A-C illustrate an example of an aerosol generating device 200, cartridge 100, and adaptor 300. The aerosol generating device 200 includes a housing 210 that forms a receptacle 220 for receiving aerosol generating articles. The device 200 includes an elongate heating element 230 that extends into the receptacle 220. The heating element 230 is operably coupled to control electronics 250 and power supply 240, which cooperate to heat the heating element 230. The device 200 may be, for example, a Philip Morris International iQOS® aerosol generating device or other commercially available aerosol generating device that may be configured to receive aerosol generating articles other than the cartridges described in the present disclosure.

An adaptor 300 may be used to allow the device 200 to be used with a cartridge 100 described in the present disclosure. In the depicted embodiment, the adaptor 300 comprises a housing 310 that includes a thermally conductive material to transfer heat from the heating element 230 to the cartridge 100. The housing 310 of the adaptor 300 defines a cavity 320 for receiving the cartridge 100 and a slot 330 for receiving the heating element 230 of the device 200. The adaptor 300 may be inserted into the receptacle 220 of the device 200 such that the heating element 230 is received in the slot 330, as depicted in FIG. 2B. Preferably, the heating element 230 contacts the housing 310 defining the slot 330 to make good thermal contact.

A distal end of the cartridge 100 may be inserted into the cavity 320 of the adaptor 300, as depicted in FIG. 2C. When the cartridge 100 is received in the cavity 320 of the adaptor 300 and the heating element 230 of the device 200 is received in the slot 330 of the adaptor 300, the heating element 230 of the device 200 may heat the cartridge 100 through the adaptor 300.

Using an appropriate adaptor, one example of which is depicted in FIGS. 2A-C, any suitable aerosol generating device may be employed to heat a cartridge of the present disclosure.

Figure 3:
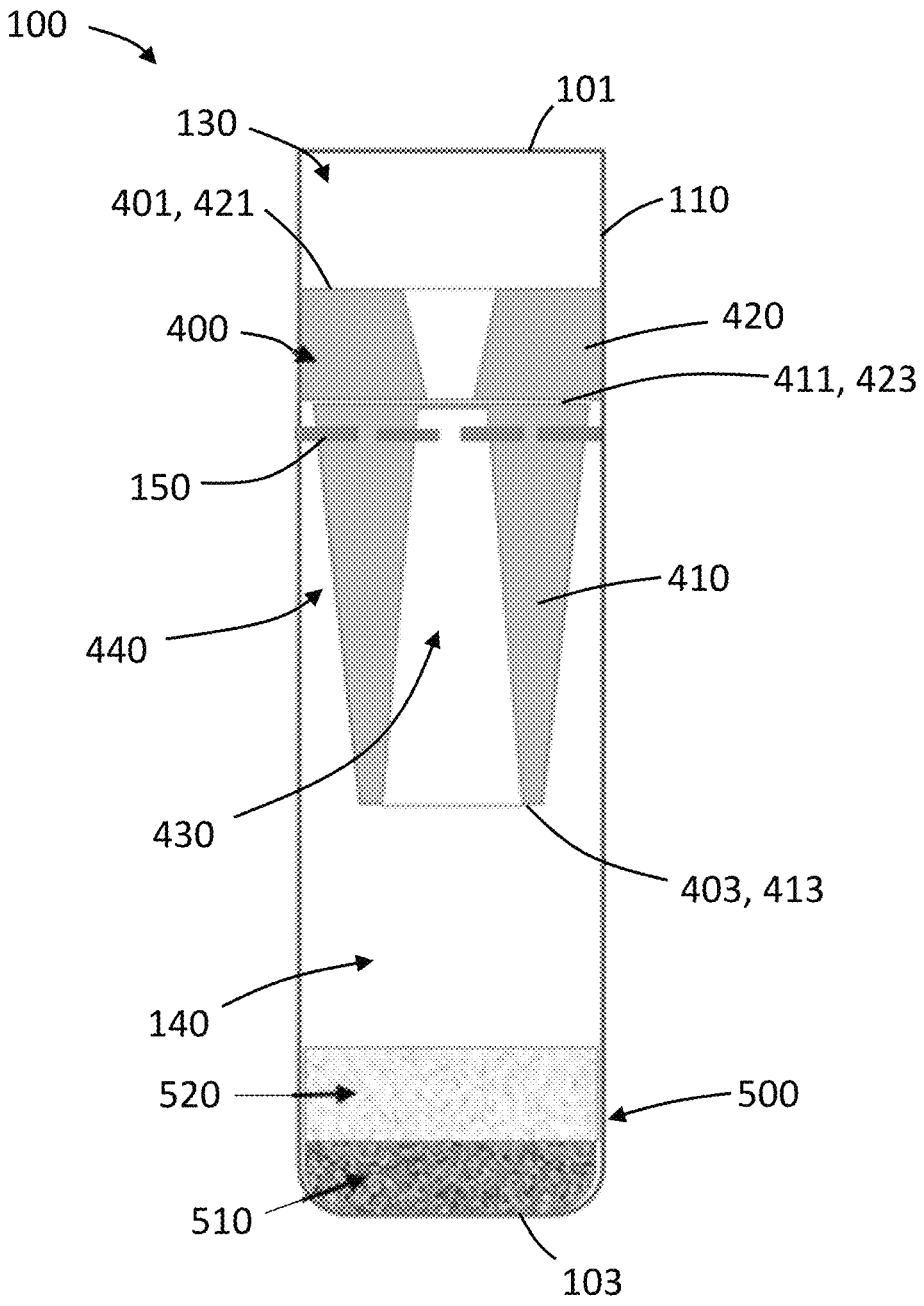
FIGS. 3-6 are schematic sectional views of various embodiments of cartridges.

FIG. 3 depicts an embodiment of a cartridge 100 including a housing 110 and a flow control apparatus 400. The housing 110 and flow control apparatus 400 may be formed from a single part or multiple parts. The flow control apparatus 400 has a proximal end 401, a distal end 403 and an interior passageway 430 from the distal end 403 to the proximal end 401. The flow control apparatus 400 has a first portion 410 and a second portion 420. The first portion 410 defines a first portion of the passageway 430, which extends from the distal end 413 of the first portion 410 to the proximal end 411 of the first portion 410. The second portion 420 defines a second portion of the passageway 430, which extends from the distal end 423 of the second portion 420 to the proximal end 421 of the second portion 420. The first portion of the passageway 430 has a constricted cross section moving from the distal end 413 to the proximal end 411 of the first portion 410 to cause air to accelerate through this portion of the passageway 430 when a negative pressure is applied to the mouth end 101 of the cartridge 100. In other words, the cross section of the first portion of the passageway narrows from the distal end 413 to the proximal end 411. The second portion of the passageway 430 has an expanding cross section from the distal end 423 to the proximal end 421 of the second portion 420 of the flow control apparatus 400. In the second portion of the passageway 430, airflow may decelerate.

The housing 110 defines an open mouth end 101 of the cartridge 100 and a closed distal end 103. An aerosol-forming substrate 500 includes a first portion 510 comprising tobacco powder and second portion 520 comprising an aerosol-former. The second portion 520 comprises a gel that melts upon heating to allow the aerosol-former to mix with the tobacco powder in the first portion 510. The aerosol-forming substrate 500 is disposed in proximity to the closed distal end 103 of the housing 110. Aerosol generated from the aerosol-forming substrate 500 when heated may enter the headspace 140 in the housing 110 above the aerosol-forming substrate 500 to be carried through the passageway 430.

Apertures 150 extend through the housing 110. At least one aperture 150 is in communication with a channel 440 formed between an outer surface of the flow control apparatus 400 and an inner surface of the housing 110. A seal is formed between the flow control apparatus 400 and the housing 110 at a location between the apertures 150 and the mouth end 101.

When a user draws on the mouth end 101 of the cartridge 100, air enters the apertures 150, flows through the channel 440 into the headspace 140 above the aerosol-forming substrate 500, where the air may entrain aerosol formed when the aerosol-forming substrate 500 is heated. The air may then flow through the airflow passageway 430, and through the mouth end. As air flows through the first portion of the passageway 430, the airflow accelerates. As air flows through the second portion of the passageway 430, the airflow decelerates. The second portion of the airflow passageway 430 is optional. In the depicted embodiment, the housing defines a cavity 130 between proximal end 401 of the flow control apparatus 400 and the mouth end 101 of the cartridge 100, which could serve to decelerate the airflow prior to exiting the mouth end 101.

In FIG. 3, the aerosol-forming substrate 500 includes two portions, a first portion 510 comprising tobacco powder and a second portion 520 comprising an aerosol former. The second portion 520 comprise a gel and is in contact with the first portion 510. The first portion 510 is closer to the closed distal end 103 of the housing 110. The first 510 and second 520 portions are stacked perpendicular to a longitudinal axis of the housing 110.

Figure 4:
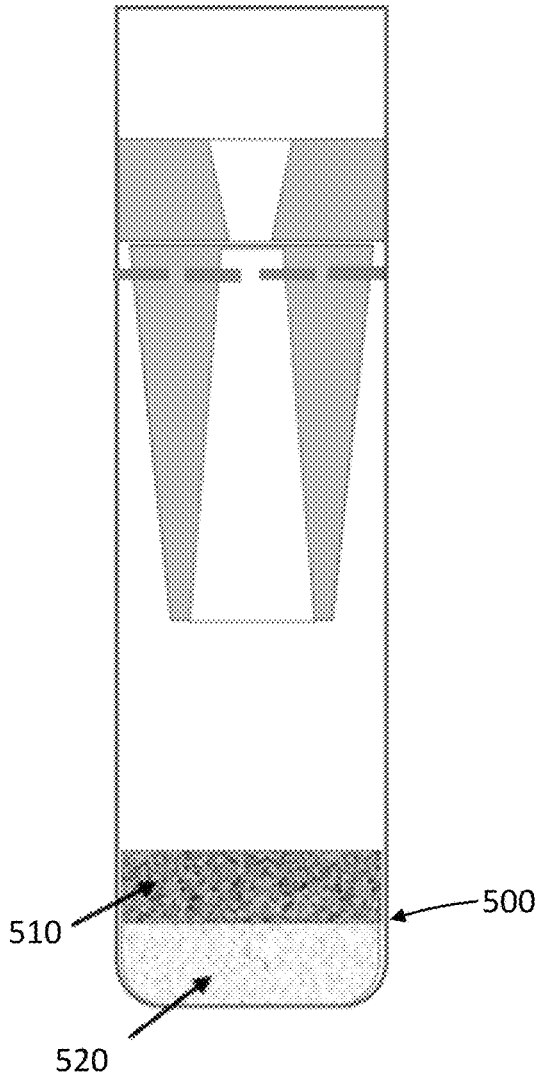
Figure 5:
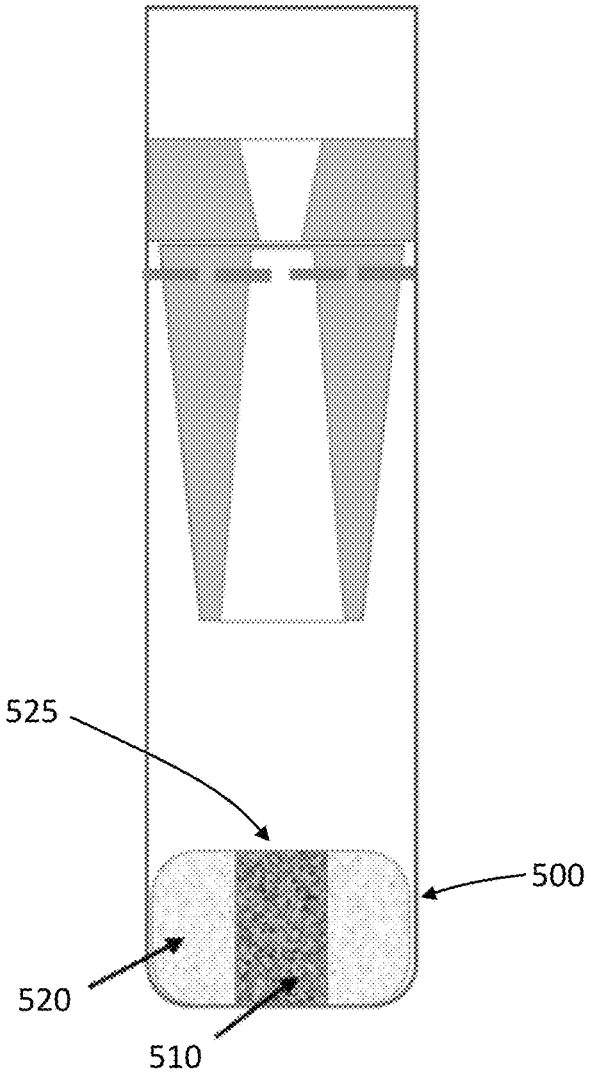
Figure 6:
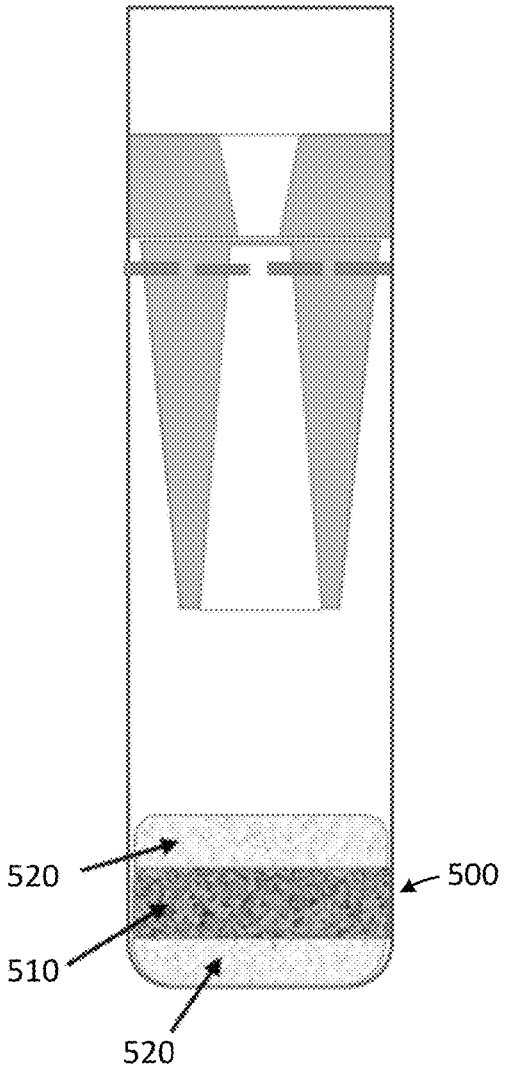

FIGS. 4-6 illustrate additional orientations of the aerosol-forming substrate 500 in the housing of the cartridge. Because components of the cartridge other than the aerosol-forming substrate 500 are the same between FIG. 3 and FIGS. 4-6, the other components are not labeled in FIGS. 4-6 for purposes of brevity.

In FIG. 4, the aerosol-forming substrate 500 includes two portions, a first portion 510 comprising tobacco powder and a second portion 520 comprising an aerosol former. The second portion 520 comprise a gel and is in contact with the first portion 510. The second portion 510 is closer to the closed distal end 103 of the housing 110. The first 510 and second 520 portions are stacked perpendicular to a longitudinal axis of the housing 110.

In FIG. 5, the aerosol-forming substrate 500 includes two portions, a first portion 510 comprising tobacco powder and a second portion 520 comprising an aerosol former. The second portion 520 comprise a gel and is in contact with the first portion 510. The second portion 520 defines an interior opening 525. In other words, the second portion 520 may be annular shaped. The first portion 510 is disposed in the interior opening 525 of the second portion 520. The first 510 and second 520 portions are oriented substantially parallel to a longitudinal axis of the housing 110.

In FIG. 6, the aerosol-forming substrate 500 includes three portions, a first portion 510 comprising tobacco powder and two second portions 520 comprising an aerosol former. The second portions 520 comprise a gel and are in contact with the first portion 510. The first portion 510 is disposed between the two second portions 520. The first 510 and second 520 portions are stacked perpendicular to a longitudinal axis of the housing 110.

Figure 7:
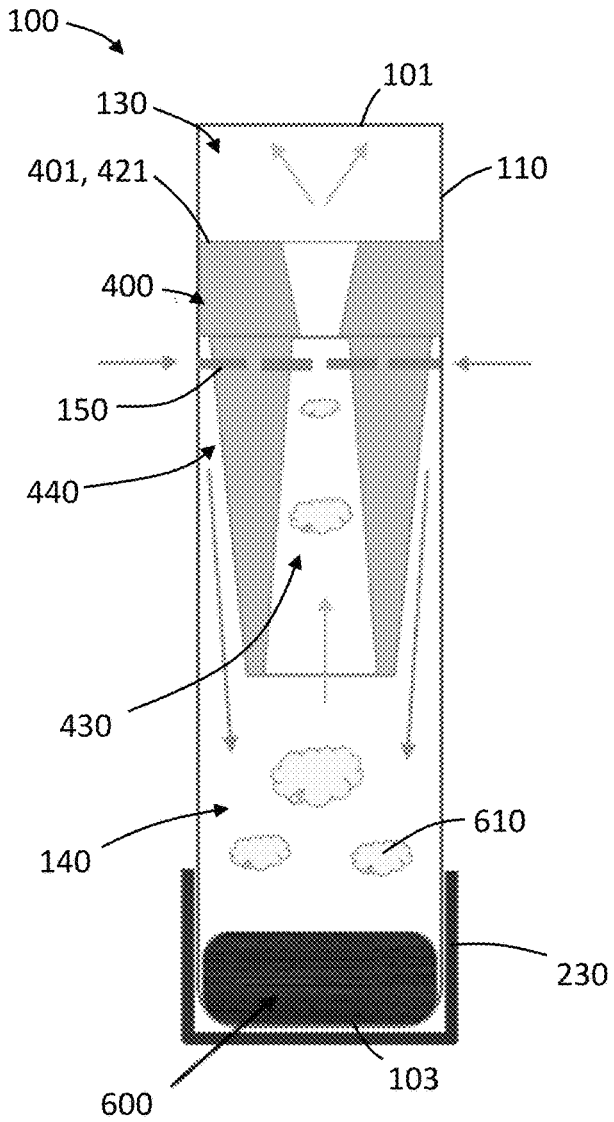
FIG. 7 is a schematic sectional side view of a cartridge heated by a heating element.

In FIG. 7, a distal portion of the cartridge 100 is in contact with a heating element 230 configured to apply heat to the closed end 103 of the housing. Following application of heat from the heating element 230, the gel of the second portion melts to form a mixture 600 with the tobacco powder. When sufficiently heated, the aerosol-former from the gel and constituents of the tobacco powder produce an aerosol 610. When a negative pressure is applied to the mouth end 101 of the cartridge 100, air enters aperture 150, flows through channel 440 between an exterior of flow control apparatus 400 and an interior of the housing 110, flows into headspace 140, entrains aerosol 610, and then flows through central opening 430 of flow control apparatus 400 for inhalation by the user. The mixture 600 may be a mixture produced by heating an aerosol-forming substrate as depicted in any one of FIGS. 3-6.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Any direction referred to herein, such as "top," "bottom," "left," "right," "upper," "lower," and other directions or orientations are described herein for clarity and brevity are not intended to be limiting of an actual device or system. Devices and systems described herein may be used in a number of directions and orientations.

The embodiments exemplified above are not limiting. Other embodiments consistent with the embodiments described above will be apparent to those skilled in the art.

The invention claimed is:

1. A cartridge for use with an aerosol generating device, the cartridge comprising:

a housing; and an aerosol-forming substrate disposed in the housing, wherein the aerosol-forming substrate comprises a first portion comprising tobacco powder, wherein the tobacco powder comprises a majority of the first portion, and a second portion comprising gel, wherein the gel comprises an aerosol former, and wherein the first portion is adjacent the second portion, wherein the housing is adapted to receive heat such that the gel in the second portion melts and forms a mixture with the tobacco powder in the adjacent first portion.

2. The cartridge according to claim 1, wherein the housing defines an open end, a closed end, and an aperture between the closed end and the open end, wherein the aerosol-forming substrate is disposed in proximity to the closed end, and wherein the cartridge further comprises:

a flow control apparatus disposed in the housing, the flow control apparatus comprising a proximal end, a distal end, and an internal airflow passageway between the distal end and the proximal end, wherein the proximal end is closer to the open end of the housing than the distal end.

3. The cartridge according to claim 2, wherein the cartridge further comprises:

a seal between an exterior of the flow control apparatus and an interior of the housing, wherein the seal is between the open end of the housing and the aperture of the housing.

4. The cartridge according to claim 3, wherein the cartridge further comprises:

a channel between a portion of the exterior of the flow control apparatus and the interior of the housing, wherein the channel is in communication with the aperture and directs air towards the aerosol-forming substrate.

5. The cartridge according to claim 2, wherein the internal airflow passageway is configured to accelerate air as it flows from the distal end towards the proximal end of the flow control apparatus.

6. The cartridge according to claim 1, wherein the first portion comprises about 10 mg to about 50 mg of tobacco powder, preferably, wherein the cartridge comprises about 20 mg to about 40 mg of tobacco powder.

7. The cartridge according to claim 1, wherein the aerosol former comprises glycerol, preferably, the gel comprises from about 50 percent by weight to about 95 percent by weight glycerol, preferably, the gel comprises about 65 percent to about 70 percent by weight glycerol.

8. The cartridge according to claim 1, wherein the gel comprises about 1 percent to about 5 percent of binder, preferably, agar.

9. The cartridge according to claim 1, wherein the aerosol-forming substrate comprises two second portions, and wherein the first portion is disposed between the two second portions such that each of the two second portions contacts the first portion.

10. The cartridge according to claim 1, wherein the first and second portions are stacked perpendicular to a longitudinal axis of the housing.

11. The cartridge according to claim 1, wherein the first and second portions are stacked parallel to a longitudinal axis of the housing.

12. The cartridge according to claim 1, wherein the second portion comprises an interior opening, and wherein the first portion is disposed in the interior opening.

13. The cartridge according to claim 1, wherein the tobacco powder comprises less than 5 percent of a weight of tobacco powder tobacco dust that is produced as a by-product from processing of tobacco material.

14. A system comprising:

the cartridge according to claim 1; and an aerosol generating device comprising a receptacle configured to receive at least a closed end of the housing and a heater operably coupled to the receptacle and configured to heat the cartridge when received in the receptacle.

* * * * *